US012104621B2

(12) United States Patent
Okuno

(10) Patent No.: US 12,104,621 B2
(45) Date of Patent: Oct. 1, 2024

(54) NON-CLOGGING PUMP

(71) Applicant: Tsurumi Manufacturing Co., Ltd., Osaka (JP)

(72) Inventor: Yoshiaki Okuno, Yawata (JP)

(73) Assignee: Tsurumi Manufacturing Co., Ltd., Osaka (JP)

( * ) Notice: Subject to any disclaimer, the term of this patent is extended or adjusted under 35 U.S.C. 154(b) by 0 days.

(21) Appl. No.: 18/009,772

(22) PCT Filed: Dec. 15, 2020

(86) PCT No.: PCT/JP2020/046695
§ 371 (c)(1),
(2) Date: Dec. 12, 2022

(87) PCT Pub. No.: WO2021/260974
PCT Pub. Date: Dec. 30, 2021

(65) Prior Publication Data

US 2023/0258188 A1 Aug. 17, 2023

(30) Foreign Application Priority Data

Jun. 22, 2020 (JP) ..... 2020-107234

(51) Int. Cl.
*F04D 7/04* (2006.01)
*F04D 29/22* (2006.01)
(Continued)

(52) U.S. Cl.
CPC ..... *F04D 7/045* (2013.01); *F04D 29/2216* (2013.01); *F04D 29/2288* (2013.01);
(Continued)

(58) Field of Classification Search
CPC .. F04D 7/045; F04D 29/2216; F04D 29/2288; F04D 29/24; F04D 29/28; F04D 29/426
See application file for complete search history.

(56) References Cited

U.S. PATENT DOCUMENTS 3,128,051 A 4/1964 Smith
5,460,482 A * 10/1995 Dorsch ..... F04D 7/045 415/121.1

(Continued)

FOREIGN PATENT DOCUMENTS

DE 24 52 548 A1 5/1975
GB 1 486 237 A 9/1977

(Continued)

OTHER PUBLICATIONS

International Search Report (PCT/ISA/210) issued in PCT Application No. PCT/JP2020/046695 dated Feb. 22, 2021 with English translation (five (5) pages).

(Continued)

*Primary Examiner* — Christopher R Legendre
(74) *Attorney, Agent, or Firm* — Crowell & Moring LLP

(57) ABSTRACT

A non-clogging pump (100, 200, 300) includes: a pump casing (3); an impeller (4, 204) including a main plate portion (41), a vane portion (43), and a central protruding portion (42); and a rotating shaft (1), in which an end portion (431) on an inner peripheral side of the vane portion (43) is connected to an outer periphery of the central protruding portion (42) when viewed from the suction port (33*a*) side, and the impeller (4, 204) is provided with a groove portion (45) extending from an inner peripheral side to an outer peripheral side of the impeller (4, 204), between the central protruding portion (42) and the vane portion (43), when viewed from the suction port (33*a*) side.

7 Claims, 7 Drawing Sheets

(51) Int. Cl.
*F04D 29/24* (2006.01)
*F04D 29/42* (2006.01)

(52) U.S. Cl.
CPC ..... *F04D 29/24* (2013.01); *F04D 29/426* (2013.01); *F04D 29/4273* (2013.01)

(56) References Cited

U.S. PATENT DOCUMENTS

| | | | | |
|---|---|---|---|---|
| 7,811,051 | B2 * | 10/2010 | Wagner | F04D 7/045 416/198 R |
| 2004/0234370 | A1 * | 11/2004 | Simakaski | F04D 29/2288 415/121.1 |
| 2018/0051718 | A1 | 2/2018 | Kawai et al. | |
| 2023/0258188 | A1 * | 8/2023 | Okuno | F04D 29/2216 415/121.1 |

FOREIGN PATENT DOCUMENTS

| | | | |
|---|---|---|---|
| JP | 51-023805 | U | 2/1976 |
| JP | 2001-248591 | A | 9/2001 |
| JP | 2009-293547 | A | 12/2009 |
| JP | 2016-186284 | A | 10/2016 |
| JP | 6038501 | B1 | 12/2016 |
| KR | 10-0918876 | B1 | 9/2009 |
| KR | 101672432 | B1 * | 5/2015 |
| KR | 10-1892052 | | 8/2018 |

OTHER PUBLICATIONS

Japanese-language Written Opinion (PCT/ISA/237) issued in PCT Application No. PCT/JP2020/046695 dated Feb. 22, 2021 (five (5) pages).

Japanese-language Office Action issued in Japanese Application No. 2020-107234 dated Oct. 19, 2021 with English translation (eight (8) pages).

Extended European Search Report issued in European Application No. 20942301.1 dated May 21, 2024 (11 pages).

* cited by examiner

FIRST EMBODIMENT

FIRST EMBODIMENT

NON-CLOGGING PUMP

TECHNICAL FIELD

The present invention relates to a non-clogging pump.

BACKGROUND ART

Conventionally, a non-clogging pump provided with an impeller is known. Such a non-clogging pump is disclosed in Japanese Patent No. 6038501.

Japanese Patent No. 6038501 discloses a submersible pump that includes an impeller disposed inside a pump casing having a suction port. The impeller has a shroud having a disc shape and a plurality of vanes provided on a suction port side of the shroud and extending from an inner peripheral side to an outer peripheral side of the impeller. The plurality of vanes are spaced apart from each other. A space having a circular shape in which foreign matter is first taken in from the suction port is provided on an inner peripheral side of the plurality of vanes. The foreign matter taken in from the suction port passes through any of a plurality of paths provided between the adjacent vanes, flows from the inner peripheral side to the outer peripheral side of the impeller, and is discharged from a discharge port.

CITATION LIST

Patent Literature

[PTL 1] Japanese Patent No. 6038501

SUMMARY OF INVENTION

Technical Problem

However, in the submersible pump of Japanese Patent No. 6038501, for example, when relatively long foreign matter is sucked in from the suction port, there is a problem that the foreign matter may not immediately flow into one of the plurality of paths provided between the plurality of vanes, and the foreign matter may stay in the space having a circular shape provided on the inner peripheral side of the plurality of vanes. In addition, there is a problem that, due to the foreign matter staying in the space having a circular shape on the inner peripheral side of the plurality of vanes, the foreign matter may be caught in a U-shaped bent form so as to surround an end portion on the inner peripheral side of the vane along the end portion on the inner peripheral side of the vane, and that the impeller may be clogged up in the worst case. That is, it is considered that the submersible pump of Japanese Patent No. 6038501 has low passage performance of the foreign matter.

The present invention has been made in order to solve the problems described above, and an object of the present invention is to provide a non-clogging pump capable of improving passage performance of foreign matter.

Solution to Problem

In order to achieve the above object, according to an aspect of the present invention, there is provided a non-clogging pump including: a pump casing provided with a suction port; an impeller including a main plate portion, a vane portion that is provided on a suction port side of the main plate portion, a central protruding portion that protrudes from a center of the main plate portion to the suction port side; and a rotating shaft having one end to which the impeller is fixed, in which an end portion on an inner peripheral side of the vane portion is connected to an outer periphery of the central protruding portion when viewed from the suction port side, and the impeller is provided with a groove portion extending from an inner peripheral side to an outer peripheral side of the impeller, between the central protruding portion and the vane portion, when viewed from the suction port side.

In the non-clogging pump according to the aspect of the present invention, as described above, the end portion on the inner peripheral side of the vane portion is connected to the outer periphery of the central protruding portion protruding from the center of the main plate portion to the suction port side when viewed from the suction port side, and the groove portion extending from the inner peripheral side to the outer peripheral side of the impeller is provided between the central protruding portion and the vane portion when viewed from the suction port side, with respect to the impeller. With this, unlike the conventional configuration in which a vacant space having a circular shape is provided on the inner peripheral side of the vane portion, since the central protruding portion is provided on the inner peripheral side of the vane portion and the end portion on the inner peripheral side of the vane portion is connected to the central protruding portion, the groove portion as a flow path (path through which foreign matter passes) is clarified by the central protruding portion, the vane portion, and the suction port, so that it is possible to prevent foreign matter from staying on the inner peripheral side of the vane portion and to prevent foreign matter from being caught in a U-shaped bent form in the end portion on the inner peripheral side of the vane portion, and it is possible to cause foreign matter to smoothly pass toward a discharge port. As a result, passage performance of foreign matter can be improved.

In the non-clogging pump according to the above aspect, preferably, a depth of the groove portion gradually increases from an end portion on an inner peripheral side toward an outer peripheral side of the groove portion. With this configuration, since it is possible to increase the flow velocity of water by reducing the depth of the groove portion on the inner peripheral side of the groove portion for taking in foreign matter, foreign matter can be effectively taken into the groove portion. Further, since it is possible to secure a large passage cross-sectional area of foreign matter by increasing the depth of the groove portion on the outer peripheral side of the groove portion, it is possible to cause the foreign matter to pass through the groove portion more smoothly. With the above, the passage performance of foreign matter can be further improved.

In this case, preferably, the central protruding portion is a part of the main plate portion, and the depth of the groove portion gradually increases as a thickness of the main plate portion in an axial direction of the rotating shaft gradually decreases from an inner peripheral side toward an outer peripheral side. With this configuration, it is possible to easily form the groove portion such that the depth of the groove portion gradually increases from the inner peripheral side toward the outer peripheral side only by changing the thickness of the main plate portion.

In the non-clogging pump according to the above aspect, preferably, the central protruding portion has a recessed portion having a circular shape that is recessed to a side opposite to the suction port side, and a fixing member that fixes the impeller to the rotating shaft is disposed inside the recessed portion. With this configuration, it is possible to restrain foreign matter from being entangled in the fixing member by disposing the fixing member inside the recessed portion.

In this case, preferably, the fixing member is a nut member, and an inner peripheral surface of the recessed portion having the circular shape is disposed so as to be spaced apart from an outer peripheral surface of the nut member disposed inside the recessed portion by a predetermined distance, when viewed from the suction port side. With this configuration, since it is possible to secure a predetermined gap between the nut member and the inner peripheral surface of the recessed portion having the circular shape when viewed from the suction port side, it is possible to utilize the predetermined gap as a gap into which a tool for fastening the nut member is inserted.

In the non-clogging pump according to the above aspect, preferably, a width of the groove portion gradually increases from an inner peripheral side toward an outer peripheral side when viewed from the suction port side. With this configuration, since it is possible to secure a large passage cross-sectional area of foreign matter on the outer peripheral side of the groove portion, it is possible to cause the foreign matter to pass through the groove portion more smoothly. As a result, the passage performance of foreign matter can be further improved.

In the non-clogging pump according to the above aspect, preferably, the pump casing includes a catch portion that is provided at an inner edge portion of the suction port and that catches foreign matter contained in water and sucked in from the suction port, the impeller includes a cutting portion that cuts the foreign matter caught in the catch portion, and the catch portion overlaps both the cutting portion and the groove portion when viewed from the suction port side, during rotation of the impeller. With this configuration, even long foreign matter or the like that cannot be taken into the groove portion at one time can be cut shorter by the cutting portion in a state in which the long foreign matter is caught in the catch portion disposed relatively close to the cutting portion and the groove portion, and can be taken into the groove portion. Therefore, the passage performance of foreign matter can be further improved.

In the non-clogging pump according to the above aspect, preferably, each vane portion is provided on both sides of the central protruding portion such that the central protruding portion is sandwiched, when viewed from the suction port side. With this configuration, even in a two-vane impeller with a relatively small number of vane portions, it is possible to prevent foreign matter from staying on the inner peripheral side of the vane portion and foreign matter from being caught in a U-shaped bent form in the end portion on the inner peripheral side of the vane portion, and the flow path (path through which foreign matter passes) is clarified by the vane portions that are connected to the central protruding portion so as to sandwich the central protruding portion therebetween, so that it is possible to cause foreign matter to smoothly pass toward the discharge port and it is possible to improve the passage performance of foreign matter. Further, with the two-vane impeller, since it is possible to improve the weight balance of the impeller as compared with the one-vane impeller, it is possible to reduce vibration during rotation of the impeller and to efficiently rotate the impeller.

Advantageous Effects of Invention

According to the present invention, as described above, it is possible to provide a non-clogging pump capable of improving the passage performance of foreign matter.

DESCRIPTION OF EMBODIMENTS

Figure 1:
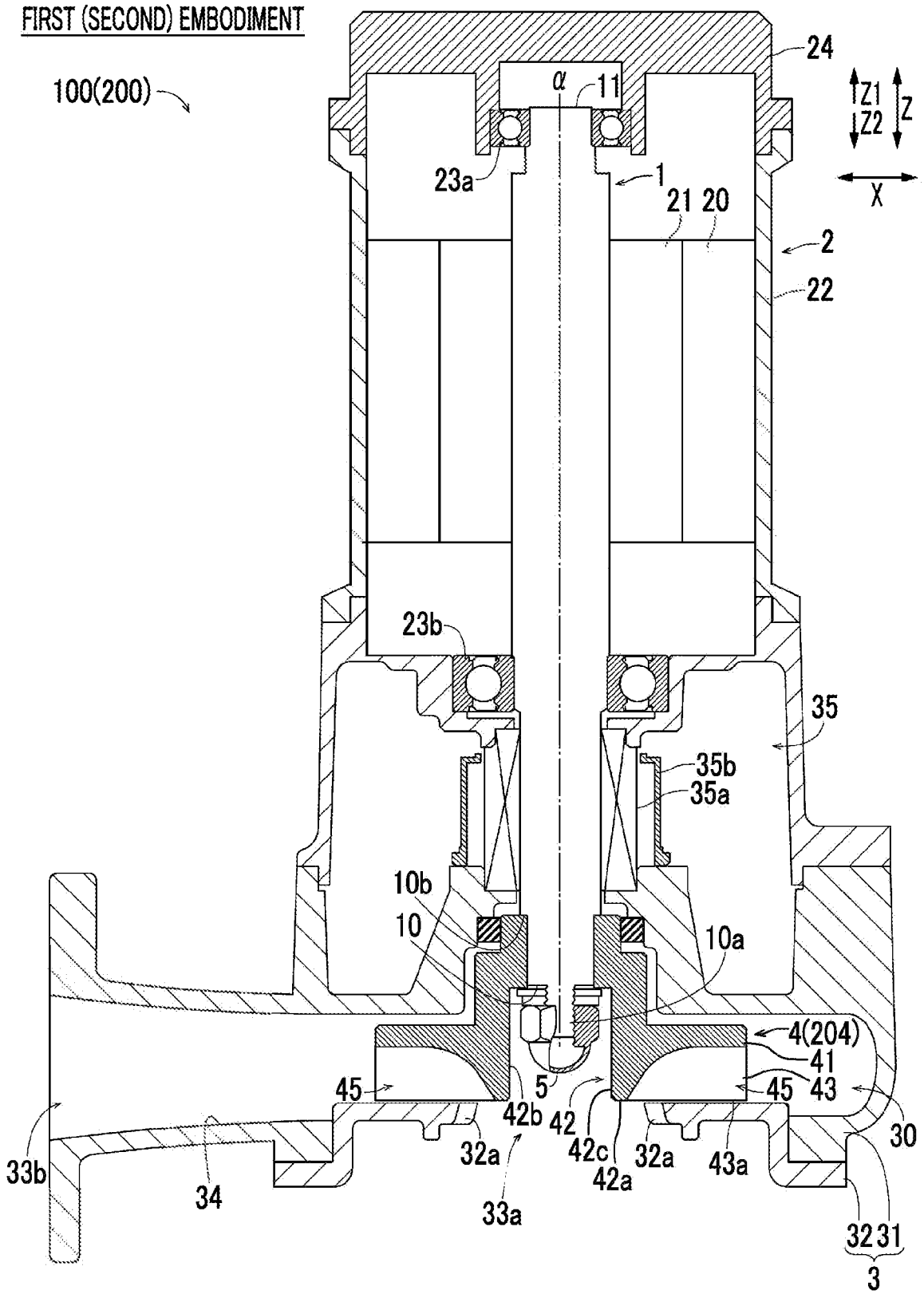
FIG. 1 is a schematic view showing an overall configuration of a non-clogging pump according to a first embodiment.

Hereinafter, embodiments will be described with reference to the drawings.

First Embodiment (Configuration of Non-Clogging Pump)

A non-clogging pump 100 of a first embodiment will be described with reference to FIGS. 1 to 5. The non-clogging pump 100 is a vertical type electric pump in which a rotation center axis $\alpha$ of a rotating shaft 1 extends in an up-down direction (Z direction).

Here, the non-clogging pump 100 of the first embodiment is configured to allow even relatively long and wide soft foreign matter (contaminant) (soft foreign matter) or the like, such as a towel, stockings, rubber gloves, bandages, or diapers, to pass (be sucked in from a suction port 33*a* of a pump casing 3 and discharged from a discharge port 33*b* of the pump casing 3) without clogging.

In each figure, a direction in which the rotation center axis $\alpha$ of the rotating shaft 1 extends is indicated by the Z direction, a direction from an impeller 4 side toward a motor 2 side in the Z direction is indicated by a Z1 direction (upward), and a direction (downward) opposite to the Z1 direction is indicated by a Z2 direction.

Further, in each figure, a predetermined direction orthogonal to the Z direction is indicated by an X direction.

As shown in FIG. 1, the non-clogging pump 100 includes the pump casing 3 in which the rotating shaft 1, the motor 2, and a pump chamber 30 are provided therein, the impeller 4, and a nut member 5 that fixes the rotating shaft 1 to the impeller 4. The nut member 5 is an example of the "fixing member" in the claims.

(Configuration of Rotating Shaft)

The rotating shaft 1 generally has a columnar shape extending in the up-down direction (Z direction). The impeller 4 is fixed to one end 10 (lower end) of the rotating shaft 1 in the Z2 direction, and the motor 2 (a rotor 21) is fixed to the other end 11 (upper end) side in the Z1 direction. The rotating shaft 1 has a function of transmitting driving force of the motor 2 to the impeller 4. As an example, the rotating shaft 1 is formed of a metal material, such as stainless steel.

A fixing member installation portion 10*a* is provided at one end 10 of the rotating shaft 1. The fixing member installation portion 10*a* is a portion in which the nut member 5 for fixing the impeller 4 to the rotating shaft 1 is installed. The fixing member installation portion 10*a* is composed of a male screw to which the nut member 5 is screwed. The fixing member installation portion 10*a* is provided on the rotation center axis α of the rotating shaft 1. The fixing member installation portion 10*a* extends so as to protrude from one end 10 in the Z2 direction, along the rotation center axis α.

The rotating shaft 1 has a contact surface 10*b* that is brought into contact with an end surface of the impeller 4 provided in the Z1 direction. The contact surface 10*b* has a function of positioning the impeller 4 with respect to the rotating shaft 1, in the Z direction. Further, the impeller 4 is fitted to the rotating shaft 1 from the lower side and a key member (not shown) is installed in a gap between the rotating shaft 1 and the impeller 4. With this, the rotating shaft 1 is formed such that the impeller 4 is positioned with respect to the rotating shaft 1 in a direction orthogonal to the Z direction. That is, the rotations of the rotating shaft 1 and the impeller 4 are synchronized.

(Configuration of Motor)

The motor 2 is configured to rotationally drive the rotating shaft 1. The motor 2 is configured to rotationally drive the impeller 4 via the rotating shaft 1. Specifically, the motor 2 includes a stator 20 having a coil, the rotor 21 disposed on the inner peripheral side of the stator 20, a frame 22, an upper bearing 23*a*, a lower bearing 23*b*, and a bracket 24. The motor 2 also includes the rotating shaft 1.

The rotating shaft 1 is fixed to the rotor 21. The motor 2 is configured to rotationally drive the rotating shaft 1 together with the rotor 21 by generating a magnetic field with the stator 20. The frame 22 covers the stator 20 and the rotor 21. The upper bearing 23*a* and the lower bearing 23*b* rotatably support the upper side and the lower side of the rotating shaft 1, respectively. The upper bearing 23*a* is installed on the bracket 24. The bracket 24 is fixed to the frame 22 from above.

(Configuration of Pump Casing)

The pump casing 3 is located on the lower side of the motor 2, and the impeller 4 is disposed in the pump chamber 30 provided inside the pump casing 3. The pump casing 3 includes a pump casing main body 31 and a suction cover 32 that is detachably attached to the pump casing main body 31 from below. The impeller 4 is introduced into the pump casing main body 31 and fastened to the rotating shaft 1 in a state in which the suction cover 32 is not attached to the pump casing main body 31.

The suction cover 32 is provided with the suction port 33*a* (indicated by an alternate long and two short dashes line in FIG. 2) directly below (Z2 direction side) the impeller 4 disposed in the pump chamber 30. The discharge port 33*b* is provided on the lateral side (direction side orthogonal to the Z direction) of the impeller 4 disposed in the pump chamber 30. The pump casing 3 has a flow path 34 through which water from the pump chamber 30 flows toward the discharge port 33*b* provided on the lateral side.

A facing surface 32*b* of the suction cover 32 facing the impeller 4 has a plurality of grooves 32*c* that are provided along the rotation direction of the impeller 4 while extending linearly from the inner peripheral side toward the outer peripheral side of the pump casing 3. (See FIG. 5). When foreign matter enters the groove 32*c*, the plurality of grooves 32*c* are configured to push out the foreign matter to the outer peripheral side of the pump casing 3 with the rotation of the impeller 4.

A catch portion 32*a* that catches foreign matter sucked in from the suction port 33*a* is provided in the inner edge portion of the suction port 33*a* of the pump casing 3 (suction cover 32). The catch portion 32*a* is a portion having a claw shape that protrudes toward the inner side of the suction port 33*a* when viewed from the suction port 33*a* side (from below (Z2 direction side)) (see FIG. 2). A plurality of the catch portions 32*a* are provided over the entire inner edge portion of the suction port 33*a*.

Figure 2:
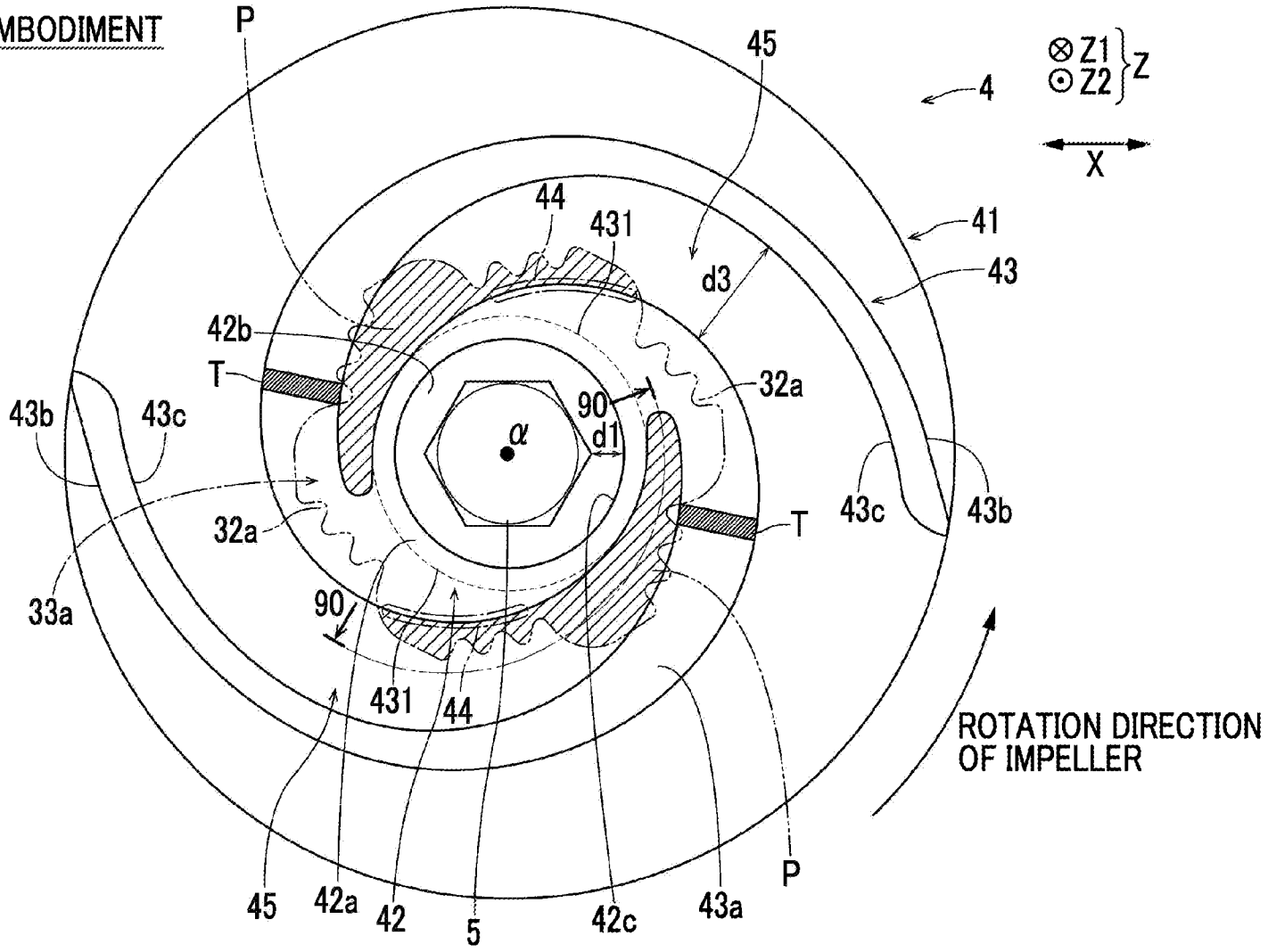
FIG. 2 is a bottom view showing an impeller and a suction port of the non-clogging pump according to the first embodiment.

As shown in FIG. 2, the suction port 33*a* is formed to be smaller than the impeller 4 when viewed from below (Z2 direction side), and the entire suction port 33*a* is disposed inside the outer edge portion having a circular shape of the impeller 4. The center position of the suction port 33*a* substantially coincides with the rotation center axis α of the rotating shaft 1 when viewed from below.

The catch portion 32*a* overlaps both a cutting portion 44 (described later) of the impeller 4, and a groove portion 45 (described later) of the impeller 4 when viewed from the suction port 33*a* side (from below), during the rotation of the impeller 4.

As shown in FIG. 1, an oil chamber 35 is provided between the motor 2 and the pump chamber 30. A mechanical seal 35*a* and an oil lifter 35*b* are installed in the oil chamber 35.

(Configuration of Impeller)

The impeller 4 is a semi-open type impeller. As an example, the impeller 4 is formed of a metal material, such as ductile cast iron.

Figure 3:
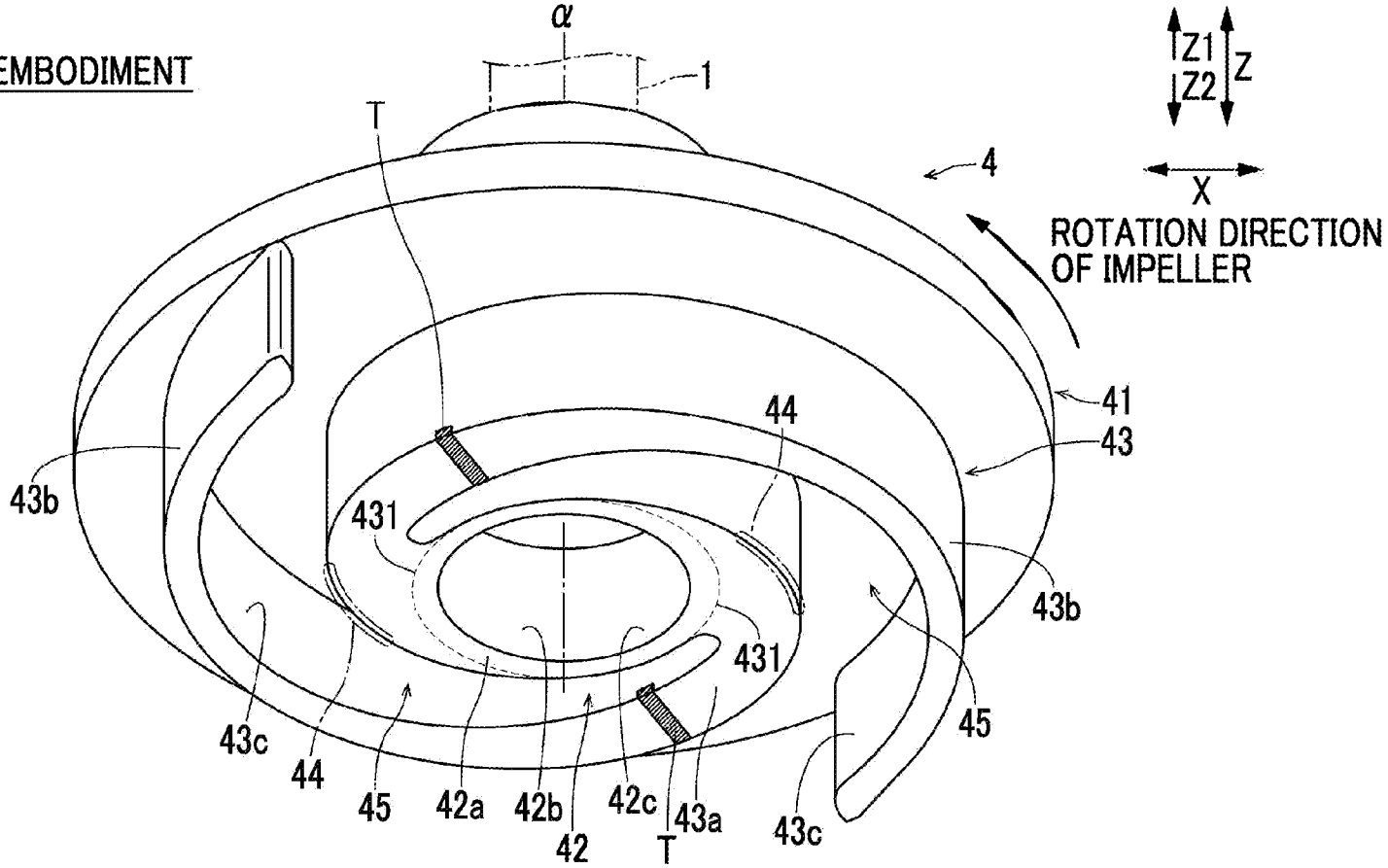
FIG. 3 is a perspective view showing the impeller of the non-clogging pump according to the first embodiment.

As shown in FIGS. 2 and 3, the impeller 4 includes a main plate portion (shroud) 41, a central protruding portion 42 protruding from the center of the main plate portion 41 toward the suction port 33*a* side (downward), a vane portion (vane) 43 provided on the suction port 33*a* side (lower side) of the main plate portion 41, and the cutting portion 44. Further, in FIG. 2 (when the non-clogging pump 100 is viewed from the bottom surface side), the impeller 4 rotates in the counterclockwise direction.

<Configuration of Main Plate Portion>

The main plate portion 41 has an outer edge portion having a circular shape and extends in a direction (X direction) orthogonal to the Z direction. The vane portion 43 is connected (integrally formed) to the lower side (Z2 direction side) of the main plate portion 41, in the Z direction.

<Configuration of Central Protruding Portion>

As shown in FIG. 2, the central protruding portion 42 is located near the center of the impeller 4 when viewed from the suction port 33*a* side (from below). The central protruding portion 42 is a part of the main plate portion 41.

The central protruding portion 42 is a portion that gradually protrudes downward (in the Z2 direction) in a mountain shape from the outer edge portion having a circular shape toward the inner peripheral side of the main plate portion 41 (see FIG. 1). That is, the thickness of the impeller 4 in the axial direction (Z direction) of the rotating shaft 1 gradually decreases from the inner peripheral side (central protruding portion 42 side) toward the outer peripheral side.

A flat lower end surface 42*a* extending in a direction substantially orthogonal to the Z direction is formed at the lower end of the central protruding portion 42.

The lower end surface 42*a* is formed in an annular shape by a recessed portion 42*b*, which will be described later, formed inside the central protruding portion 42, when viewed from the suction port 33*a* side (from below). The entire lower end surface 42*a* is disposed inside the inner edge portion of the suction port 33*a*, in which the catch portion 32*a* of the suction port 33*a* is formed, when viewed from the suction port 33*a* side (from below). The center position of the lower end surface 42*a* having an annular shape substantially coincides with the rotation center axis α of the rotating shaft 1 when viewed from the suction port 33*a* side (from below).

The central protruding portion 42 has the recessed portion 42*b* having a circular shape that is recessed to the side (upward) opposite to the suction port 33*a* side. Therefore, the central protruding portion 42 is generally formed in a tubular shape by the recessed portion 42*b*. The central protruding portion 42 is formed such that the nut member (cap nut) 5 for fixing the impeller 4 to the rotating shaft 1 is disposed inside the recessed portion 42*b*.

An inner peripheral surface 42*c* of the recessed portion 42*b* having a circular shape is disposed so as to be spaced apart from the outer peripheral surface of the nut member 5 disposed inside the recessed portion 42*b* by a predetermined distance d1, when viewed from the suction port 33*a* side (from below). That is, a space having a predetermined size is secured around the nut member 5 when viewed from the suction port 33*a* side (from below). The nut member 5 is screwed to the fixing member installation portion 10*a* formed by the male screw, by a predetermined tool (not shown) that is inserted into the recessed portion 42*b* by utilizing the space provided in the recessed portion 42*b*. The predetermined tool is a tool (for example, a socket wrench) for tightening and loosening the nut member 5.

An end portion 431 on the inner peripheral side of the vane portion 43 is connected to the outer periphery of the central protruding portion 42 having a tubular shape, when viewed from the suction port 33*a* side (from below). The lower end of the central protruding portion 42 (lower end surface 42*a* having an annular shape) and the lower end of the vane portion 43 (a lower end surface 43*a*, which will be described later) are continuous with each other and are disposed at substantially the same height position in the Z direction. That is, the lower end of the central protruding portion 42 and the lower end of the vane portion 43 are smoothly connected to each other with no difference in level.

<Configuration of Vane Portion>

Each vane portion 43 is provided on both sides of the central protruding portion 42 such that the central protruding portion 42 is sandwiched, when viewed from the suction port 33*a* side (from below). That is, two vane portions 43 are provided. The lower end surface 43*a* of the vane portion 43 is disposed close to the upper surface of the suction cover 32.

The vane portion 43 has the flat lower end surface 43*a* extending in a direction orthogonal to the Z direction, and one surface 43*b* and the other surface 43*c* that sandwich the lower end surface 43*a* therebetween when viewed from below.

One surface 43*b* of the vane portion 43 is a surface on a side serving as the cutting portion 44 when the impeller 4, which will be described later, rotates in the forward direction. One surface 43*b* is smoothly connected to the outer periphery of the central protruding portion 42 having a tubular shape, when viewed from the suction port 33*a* side (from below). Specifically, one surface 43*b* of the vane portion 43 is smoothly connected to the outer periphery of the central protruding portion 42 so as to tangentially coincide with the central protruding portion 42 having a tubular shape (lower end surface 42*a* having an annular shape), when viewed from the suction port 33*a* side (from below).

That is, one surface 43*b* of the vane portion 43 and the central protruding portion 42 having a tubular shape (lower end surface 42*a* having an annular shape) are smoothly connected to each other by a common arc substantially centered on the rotation center axis α of the rotating shaft 1, when viewed from the suction port 33*a* side (from below).

The impeller 4 is provided with a plurality of (two) groove portions 45 extending from the inner peripheral side to the outer peripheral side of the impeller 4, between the central protruding portion 42 and the vane portions 43, when viewed from the suction port 33*a* side (from below). The non-clogging pump 100 is configured to suck in foreign matter from two openings P (indicated by hatching in FIG. 2) where the end portions on the inner peripheral sides of the groove portions 45 and the suction port 33*a* overlap each other, when viewed from the suction port 33*a* side (from below). In this way, since one surface 43*b* of the vane portion 43 and the central protruding portion 42 having a tubular shape (lower end surface 42*a* having an annular shape) are smoothly connected to form the groove portion 45, the suction port 33*a* is segmented, and the flow path (path through which foreign matter passes) is clarified, so that it is possible to cause foreign matter to smoothly pass toward the discharge port 33*b*.

<Configuration of Groove Portion>

The groove portion 45 forms a path through which foreign matter that has flowed into the inside of the suction port 33*a* from the outside of the suction port 33*a* passes. The foreign matter flows into the groove portion 45 (the space inside the groove portion 45) from the end portion on the inner peripheral side toward the outer peripheral side of the groove portion 45.

As in the vane portion 43, each groove portion 45 is provided on both sides of the central protruding portion 42 such that the central protruding portion 42 is sandwiched, when viewed from the suction port 33*a* side (from below). That is, two groove portions 45 are provided.

Therefore, the non-clogging pump 100 is provided with two openings P into which foreign matter flows, at positions where the suction port 33*a* and two groove portions 45 overlap each other, when viewed from the suction port 33*a* side (from below). Since the non-clogging pump 100 is configured to increase the flow velocity of water passing through the openings P by causing the foreign matter to flow in through two openings P having a smaller opening area than the suction port 33*a*, instead of causing the foreign matter to flow in through the entire suction port 33*a*.

The groove portion 45 extends from the inner peripheral side toward the outer peripheral side of the impeller 4 while being curved along the vane portion 43. The groove portion 45 is provided at a position sandwiched between the other surface 43*c* of the vane portion 43 and the central protruding portion 42 on the inner peripheral side of the impeller 4, and is provided at a position sandwiched between one surface 43*b* of the vane portion 43 and the other surface 43*c* of the vane portion 43 on the outer peripheral side of the impeller 4, when viewed from the suction port 33*a* side (from below).

Figure 4:
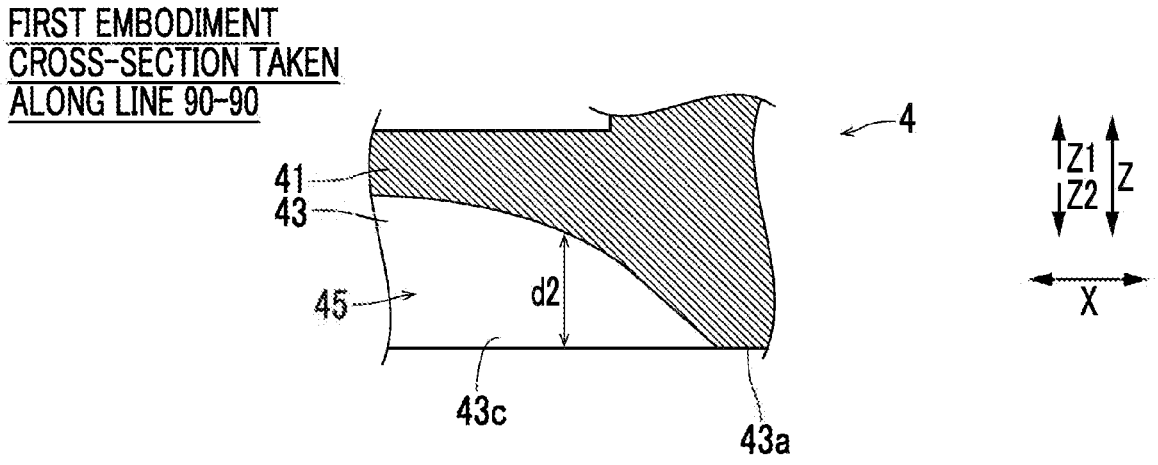
FIG. 4 is a cross-sectional view of the impeller taken along line 90-90 of FIG. 2.
Figure 5:
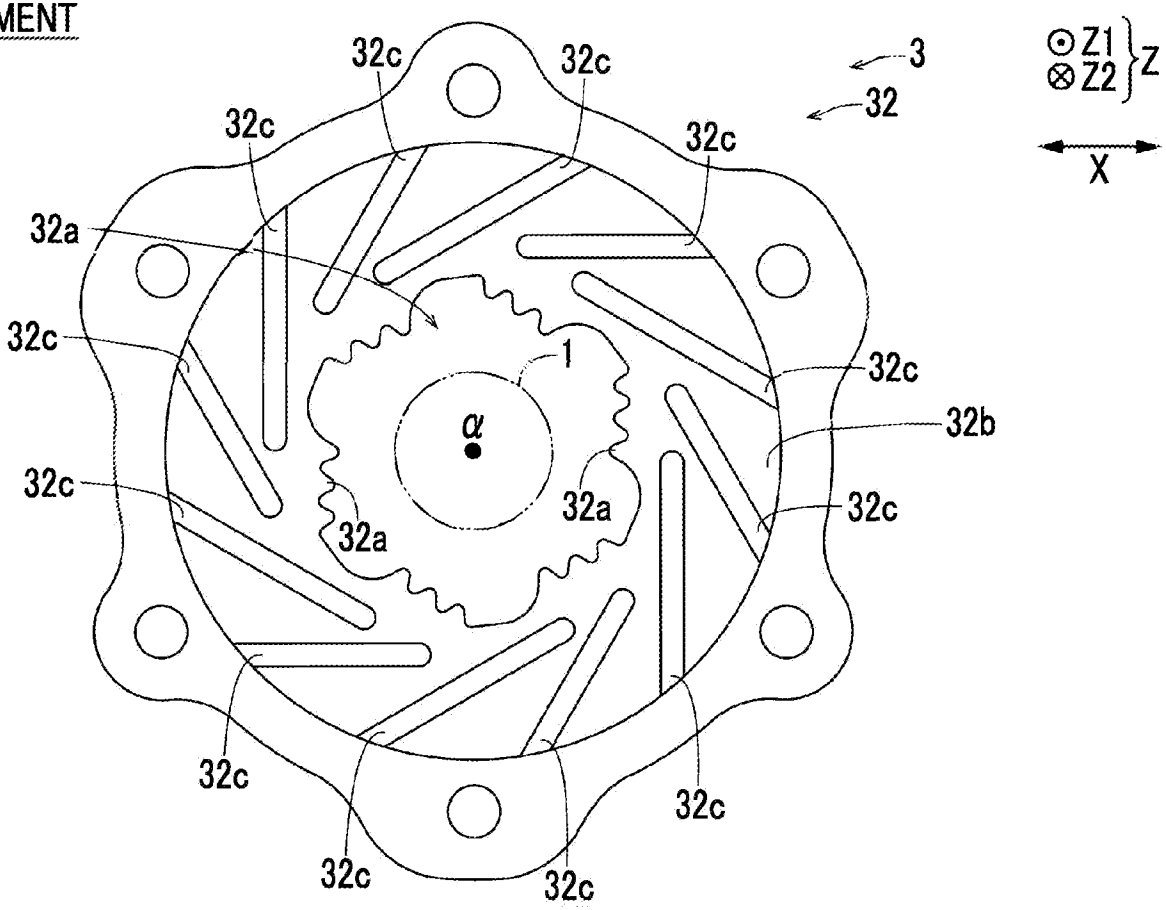
FIG. 5 is a plan view showing a suction cover of the non-clogging pump according to the first embodiment.

A depth (size in the Z direction) d2 of the groove portion 45 gradually increases from the end portion on the inner peripheral side toward the outer peripheral side of the groove portion 45 (see FIG. 4). That is, the depth d2 of the groove portion 45 gradually increases as the thickness of the main plate portion 41 in the axial direction of the rotating shaft 1 gradually decreases from the inner peripheral side toward the outer peripheral side.

Further, a width d3 of the groove portion 45 gradually increases from the inner peripheral side toward the outer peripheral side when viewed from the suction port side (from below).

Therefore, the space inside the groove portion 45 gradually increases from the inner peripheral side toward the outer peripheral side.

A cemented carbide tip T is attached to the lower end surface 43*a* of the vane portion 43. The cemented carbide tip T protrudes downward from the lower end surface 43*a* in the axial direction (Z direction) of the rotating shaft 1. As an example, the amount of protrusion of the cemented carbide tip T from the lower end surface 43*a* is 0.2 mm.

Each cemented carbide tip T is provided on one side and the other side of the rotation center axis α such that the rotation center axis α of the rotating shaft 1 is sandwiched, when viewed from the suction port 33*a* side (from below). Further, the cemented carbide tips T are sandwiched between the groove portions 45 when viewed from the suction port 33*a* side (from below).

Further, the cemented carbide tip T is disposed at a position closer to the end portion 431 than to an intermediate position between the end portion on the outer peripheral side of the vane portion 43 and the end portion 431 on the inner peripheral side of the vane portion 43, in a direction in which the vane portion 43 extends. Further, the cemented carbide tip T is disposed on the outer peripheral side with respect to the cutting portion 44, in the direction in which the vane portion 43 extends. Further, the cemented carbide tip T is disposed at a position overlapping the catch portion 32*a* when viewed from the suction port 33*a* side (from below), during the rotation of the impeller 4. Further, the cemented carbide tip T is provided across the vane portion 43 from a surface on one side to a surface on the other side in the thickness direction.

The non-clogging pump 100 is configured to crush foreign matter that has flowed in from the suction port 33*a* at two portions, that is, the cutting portion 44 and the cemented carbide tip T protruding from the vane portion 43. Therefore, the non-clogging pump 100 can make the crushed matter obtained by crushing the foreign matter finer.

<Configuration of Cutting Portion>

The cutting portion 44 (indicated by being surrounded by an alternate long and short dash line in FIGS. 2 and 3) is formed by a corner portion provided on one surface 43*b* side and on the lower side of the vane portion 43. The cutting portion 44 is located on the inner peripheral side of the impeller 4. The cutting portion 44 is configured to cut foreign matter caught in the catch portion 32*a* of the suction port 33*a*.

Specifically, the cutting portion 44 is configured to cut the foreign matter caught in the catch portion 32*a* by sandwiching the foreign matter between the pump casing 3 and the cutting portion 44 while the impeller 4 rotates in the forward direction. With this, the foreign matter caught in the catch portion 32*a* becomes smaller and flows into the groove portion 45.

Effect of First Embodiment

In the first embodiment, the following effects can be obtained.

In the first embodiment, as described above, the end portion 431 on the inner peripheral side of the vane portion 43 is connected to the outer periphery of the central protruding portion 42 protruding from the center of the main plate portion 41 to the suction port 33*a* side when viewed from the suction port 33*a* side, and the groove portion 45 extending from the inner peripheral side to the outer peripheral side of the impeller 4 is provided between the central protruding portion 42 and the vane portion 43 when viewed from the suction port 33*a* side, with respect to the impeller 4. With this, unlike the conventional configuration in which a vacant space having a circular shape is provided on the inner peripheral side of the vane portion 43, since the central protruding portion 42 is provided on the inner peripheral side of the vane portion 43 and the end portion 431 on the inner peripheral side of the vane portion 43 is connected to the central protruding portion 42, the groove portion 45 as the flow path (path through which foreign matter passes) is clarified by the central protruding portion 42, the vane portion 43, and the suction port 33*a*, so that it is possible to prevent foreign matter from staying on the inner peripheral side of the vane portion 43 and to prevent foreign matter from being caught in a U-shaped bent form in the end portion 431 on the inner peripheral side of the vane portion 43, and it is possible to cause foreign matter to smoothly pass toward the discharge port 33*b*. As a result, the passage performance of foreign matter can be improved.

In the first embodiment, as described above, the depth d2 of the groove portion 45 gradually increases from the end portion on the inner peripheral side toward the outer peripheral side of the groove portion 45. With this, since it is possible to increase the flow velocity of water by reducing the depth d2 of the groove portion 45 on the inner peripheral side of the groove portion 45 for taking in foreign matter, foreign matter can be effectively taken into the groove portion 45. Further, since it is possible to secure a large passage cross-sectional area of foreign matter by increasing the depth d2 of the groove portion 45 on the outer peripheral side of the groove portion 45, it is possible to cause the foreign matter to pass through the groove portion 45 more smoothly. With the above, the passage performance of foreign matter can be further improved.

In the first embodiment, as described above, the central protruding portion 42 is a part of the main plate portion 41, and the depth d2 of the groove portion 45 gradually increases as the thickness of the main plate portion 41 in the axial direction of the rotating shaft 1 gradually decreases from the inner peripheral side toward the outer peripheral side. With this, it is possible to easily form the groove portion 45 such that the depth d2 of the groove portion 45 gradually increases from the inner peripheral side toward the outer peripheral side only by changing the thickness of the main plate portion 41.

In the first embodiment, as described above, the central protruding portion 42 has the recessed portion 42*b* having a circular shape that is recessed to the side opposite to the suction port 33*a* side, and the fixing member (nut member 5) that fixes the impeller 4 to the rotating shaft 1 is disposed inside the recessed portion 42*b*. With this, it is possible to restrain foreign matter from being entangled in the fixing member by disposing the fixing member inside the recessed portion 42*b*.

In the first embodiment, as described above, the fixing member is the nut member 5, and the inner peripheral surface 42*c* of the recessed portion 42*b* having a circular shape is disposed so as to be spaced apart from the outer peripheral surface of the nut member 5 disposed inside the recessed portion 42*b* by a predetermined distance d1, when viewed from the suction port 33*a* side. With this, since it is possible to secure a predetermined gap between the nut member 5 and the inner peripheral surface 42*c* of the recessed portion 42*b* having a circular shape when viewed from the suction port 33*a* side, it is possible to utilize the predetermined gap as a gap into which a tool for fastening the nut member 5 is inserted.

In the first embodiment, as described above, the width d3 of the groove portion 45 gradually increases from the inner peripheral side toward the outer peripheral side when viewed from the suction port 33*a* side. With this, since it is possible to secure a large passage cross-sectional area of foreign matter on the outer peripheral side of the groove portion 45, it is possible to cause the foreign matter to pass through the groove portion 45 more smoothly. As a result, the passage performance of foreign matter can be further improved.

In the first embodiment, as described above, the pump casing 3 includes the catch portion 32*a* that is provided at the inner edge portion of the suction port 33*a* and that catches foreign matter contained in water and sucked in from the suction port 33*a*, the impeller 4 includes the cutting portion 44 that cuts the foreign matter caught in the catch portion 32*a*, and the catch portion 32*a* overlaps both the cutting portion 44 and the groove portion 45 when viewed from the suction port 33*a* side, during the rotation of the impeller 4. With this, even long foreign matter or the like that cannot be taken into the groove portion 45 at one time can be cut shorter by the cutting portion 44 in a state in which the long foreign matter is caught in the catch portion 32*a* disposed relatively close to the cutting portion 44 and the groove portion 45, and can be taken into the groove portion 45. Therefore, the passage performance of foreign matter can be further improved.

In the first embodiment, as described above, each vane portion 43 is provided on both sides of the central protruding portion 42 such that the central protruding portion 42 is sandwiched, when viewed from the suction port 33*a* side. With this, even in the two-vane impeller 4 with a relatively small number of vane portions 43, it is possible to prevent foreign matter from staying on the inner peripheral side of the vane portion 43 and foreign matter from being caught in a U-shaped bent form in the end portion 431 on the inner peripheral side of the vane portion 43, and the flow path (path through which foreign matter passes) is clarified by the vane portions 43 that are connected to the central protruding portion 42 so as to sandwich the central protruding portion 42 therebetween, so that it is possible to cause foreign matter to smoothly pass toward the discharge port 33*b* and it is possible to improve the passage performance of foreign matter. Further, with the two-vane impeller 4, since it is possible to improve the weight balance of the impeller 4 as compared with the one-vane impeller, it is possible to reduce vibration during the rotation of the impeller 4 and to efficiently rotate the impeller 4.

Second Embodiment

A second embodiment will be described with reference to FIGS. 1 and 6. In this second embodiment, unlike the first embodiment in which the cemented carbide tip T is provided on the impeller 4, an example in which the cemented carbide tip is not provided on an impeller 204 will be described. In the figure, the same reference numerals are given to the parts having the same configuration as that of the first embodiment.

Figure 6:
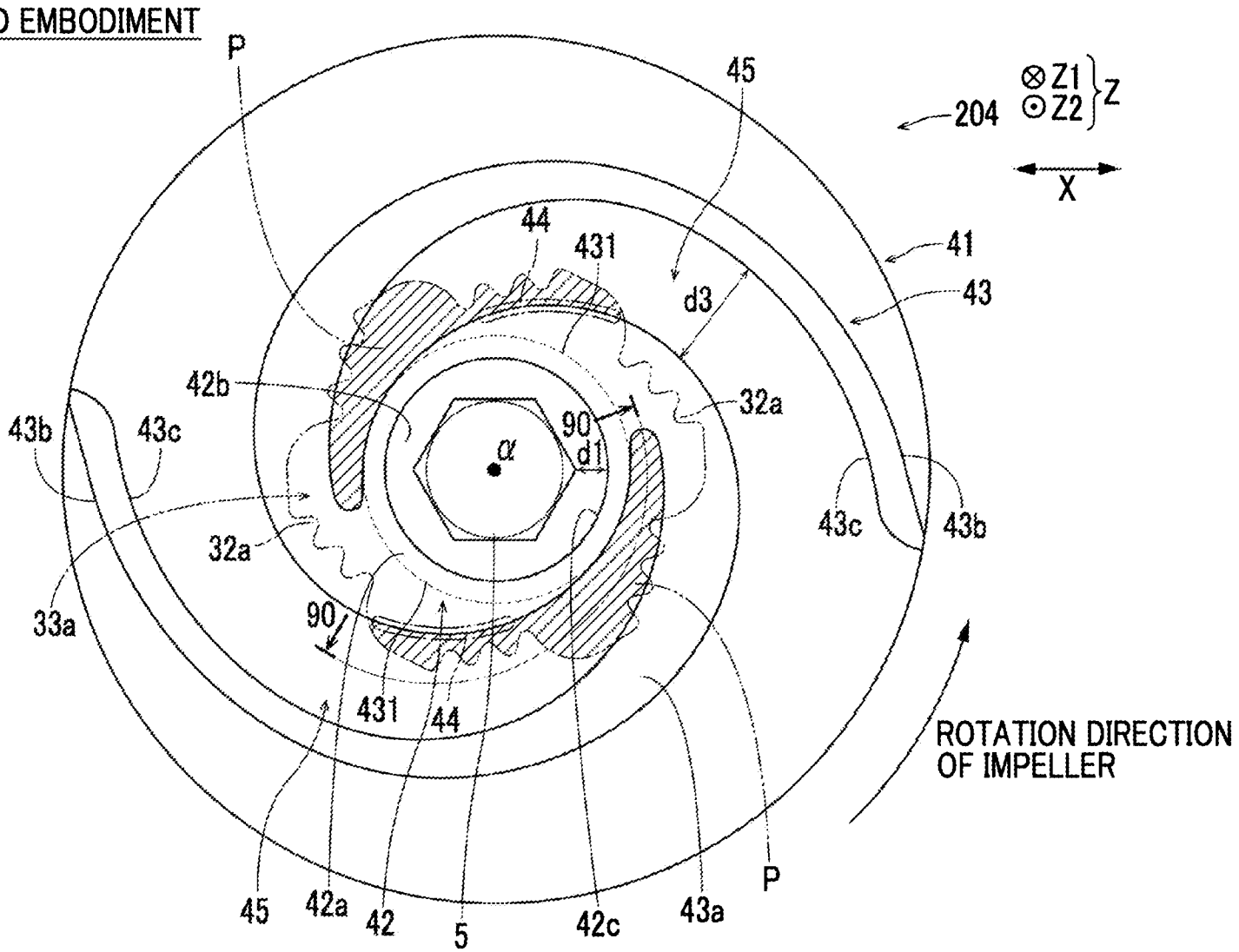
FIG. 6 is a bottom view showing an impeller and a suction port of a non-clogging pump according to a second embodiment.

As shown in FIGS. 1 and 6, a non-clogging pump 200 includes the impeller 204.

The impeller 204 has the same configuration as the impeller 4 of the first embodiment, except that the cemented carbide tip T is not provided. That is, the non-clogging pump 200 is configured to crush foreign matter that has flowed in from the suction port 33*a* through the cutting portion 44.

Effect of Second Embodiment

In the second embodiment, the following effects can be obtained.

In the second embodiment, as in the first embodiment, the end portion 431 on the inner peripheral side of the vane portion 43 is connected to the outer periphery of the central protruding portion 42 protruding from the center of the main plate portion 41 to the suction port 33*a* side when viewed from the suction port 33*a* side, and the groove portion 45 extending from the inner peripheral side to the outer peripheral side of the impeller 204 is provided between the central protruding portion 42 and the vane portion 43 when viewed from the suction port 33*a* side, with respect to the impeller 204. With this, the passage performance of foreign matter can be improved as in the first embodiment.

(Modification Example)

It should be noted that the embodiment disclosed herein is an example in all respects and is not considered to be restrictive. The scope of the present invention is shown by the claims, not the description of the above-described embodiment, and includes all modifications (modification examples) within the meaning and scope equivalent to the claims.

Figure 7:
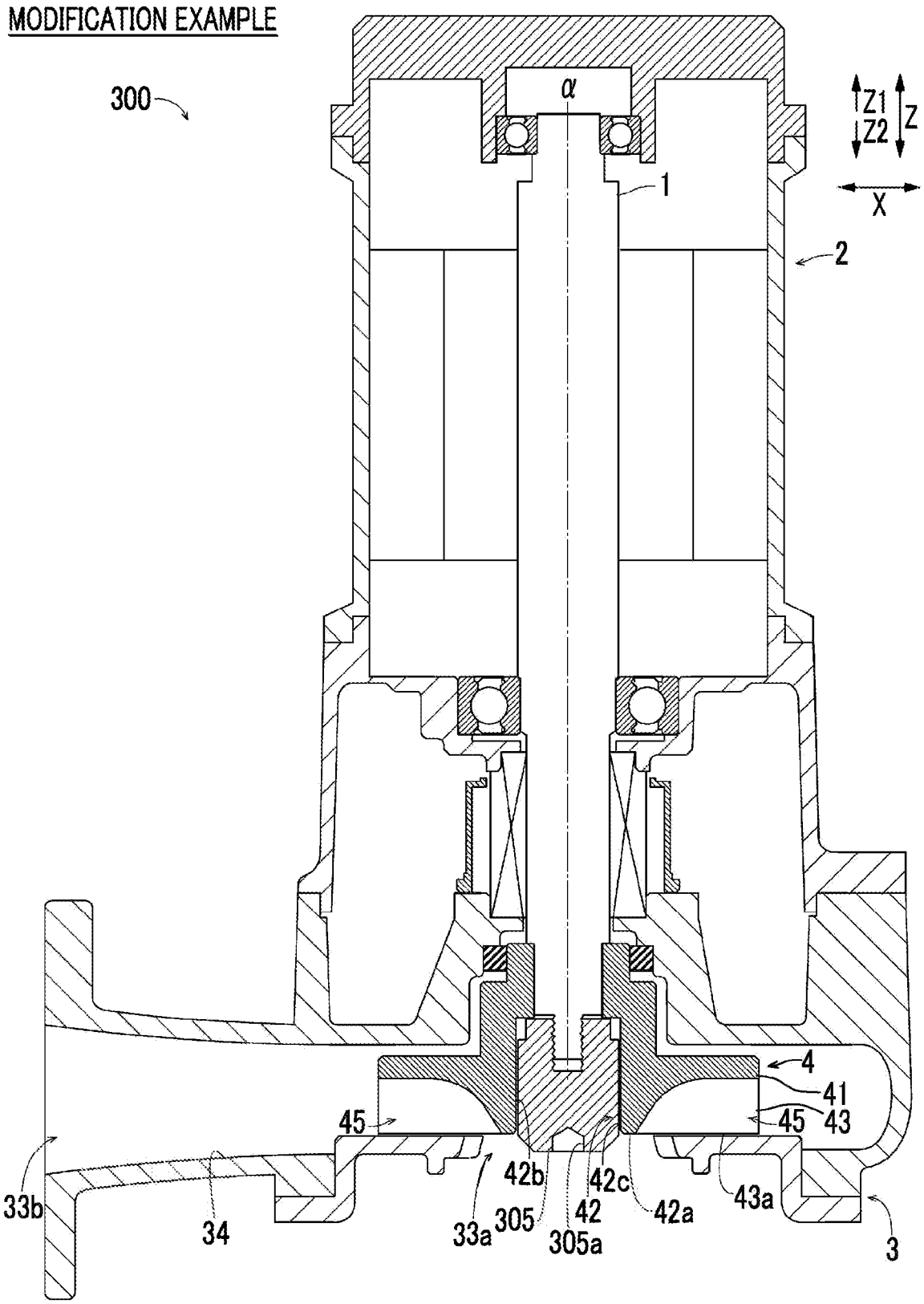
FIG. 7 is a schematic view showing an overall configuration of a non-clogging pump according to a modification example.

For example, in the first and second embodiments, an example has been shown in which a gap of a predetermined distance d1 (see FIG. 2) is provided between the inner peripheral surface having a circular shape of the recessed portion and the outer peripheral surface of the nut member (cap nut), but the present invention is not limited thereto. In the present invention, as in a non-clogging pump 300 of the modification example shown in FIG. 7, a gap between the inner peripheral surface 42*c* having a circular shape of the recessed portion 42*b* and the outer peripheral surface of a circular nut member 305 may not be substantially provided. An insertion port 305*a* of a bar wrench is provided at the lower end of the circular nut member 305. The circular nut member 305 is an example of the "fixing member" in the claims.

Further, in the first and second embodiments, an example has been shown in which the non-clogging pump is a vertical type pump (a pump in which the rotating shaft extends in the up-down direction), but the present invention is not limited thereto. In the present invention, the non-clogging pump may be a horizontal type pump (a pump in which the rotating shaft extends in the horizontal direction).

Further, in the first and second embodiments, an example has been shown in which the pump casing includes the suction cover, but the present invention is not limited thereto. In the present invention, the pump casing may not include the suction cover, and the pump casing (pump casing main body) may have a suction port and a catch portion.

Further, in the first and second embodiments, an example has been shown in which the fixing member of the present invention has a female screw (nut member), but the present invention is not limited thereto. In the present invention, the fixing member of the present invention may have a male screw (for example, a bolt). In this case, a female screw is formed on the rotating shaft.

Further, in the first and second embodiments, an example has been shown in which the impeller has two vane portions, but the present invention is not limited thereto. In the present invention, the impeller may include one or three or more vane portions.

Further, in the first and second embodiments, an example has been shown in which the impeller is formed such that the depth of the groove portion changes, but the present invention is not limited thereto. In the present invention, the impeller may be formed such that the depth of the groove portion is constant without changing.

Further, in the first and second embodiments, an example has been shown in which the central protruding portion is formed so as to have a generally cylindrical shape, but the present invention is not limited thereto. In the present invention, the central protruding portion may be formed into a polygonal tubular shape or the like.

Further, in the first and second embodiments, an example has been shown in which the central protruding portion of the impeller has the recessed portion, but the present invention is not limited thereto. In the present invention, the central protruding portion of the impeller may not have the recessed portion. In this case, the fixing member is disposed on the lower end surface of the central protruding portion of the impeller.

Further, in the first and second embodiments, an example has been shown in which the suction port is provided in the center of the suction cover such that the rotation center axis of the rotating shaft and the center of the suction port substantially coincide with each other, but the present invention is not limited thereto. In the present invention, the suction port may be provided at a position deviating from the center of the suction cover such that the rotation center axis of the rotating shaft and the center of the suction port deviate from each other in the horizontal direction without substantially coinciding with each other.

Further, in the first and second embodiments, an example has been shown in which the impeller is formed of ductile cast iron, but the present invention is not limited thereto. In the present invention, the impeller may be formed of a metal material other than ductile cast iron, such as high chromium cast iron, stainless steel, and titanium.

REFERENCE SIGNS LIST

1: rotating shaft
3: pump casing
4, 204: impeller
5: nut member (fixing member)
11: one end (of the rotating shaft)
32*a*: catch portion
33*a*: suction port
41: main plate portion
42: central protruding portion
42*b*: recessed portion
43: vane portion
44: cutting portion
45: groove portion
100, 200, 300 non-clogging pump
305: circular nut member (fixing member)
431: end portion (on the inner peripheral side of the vane portion)
d1: predetermined distance (between the inner peripheral surface of the recessed portion and the outer peripheral surface of the nut member)
d2: depth (of the groove portion)
d3: width (of the groove portion)

The invention claimed is:

1. A non-clogging pump comprising:

a pump casing provided with a suction port;

an impeller including a main plate portion, a vane portion that is provided on a suction port side of the main plate portion, and a central protruding portion that protrudes from a center of the main plate portion to the suction port side; and a rotating shaft having one end to which the impeller is fixed, wherein an end portion on an inner peripheral side of the vane portion is connected to an outer periphery of the central protruding portion when viewed from the suction port side, the impeller is provided with a groove portion extending from an inner peripheral side to an outer peripheral side of the impeller, between the central protruding portion and the vane portion, when viewed from the suction port side, the pump casing includes a catch portion that is provided at an inner edge portion of an open end of the suction port, that catches foreign matter contained in water and sucked in from the suction port, and that includes a plurality of protrusions, and a depth of the groove portion gradually increases from an end portion on an inner peripheral side toward an outer peripheral side of the groove portion, a tip portion that crushes the foreign matter is embedded in a lower end surface of the vane portion, and the tip portion is disposed at a position overlapping the plurality of protrusions of the catch portion during rotation of the impeller, when viewed from the suction port side.

2. The non-clogging pump according to claim 1, wherein the central protruding portion is a part of the main plate portion, and the depth of the groove portion gradually increases as a thickness of the main plate portion in an axial direction of the rotating shaft gradually decreases from an inner peripheral side toward an outer peripheral side.

3. The non-clogging pump according to claim 1, wherein the central protruding portion has a recessed portion having a circular shape that is recessed to a side opposite to the suction port side, and a fixing member that fixes the impeller to the rotating shaft is disposed inside the recessed portion and includes a nut member or a bolt.

4. The non-clogging pump according to claim 3, wherein the fixing member is a nut member, and an inner peripheral surface of the recessed portion having the circular shape is disposed so as to be spaced apart from an outer peripheral surface of the nut member disposed inside the recessed portion by a predetermined distance, when viewed from the suction port side.

5. The non-clogging pump according to claim 1, wherein a width of the groove portion gradually increases from the inner peripheral side toward the outer peripheral side when viewed from the suction port side.

6. The non-clogging pump according to claim 1, wherein the impeller includes a cutting portion that cuts the foreign matter caught in the catch portion, the catch portion overlaps both the cutting portion and the groove portion when viewed from the suction port side, during the rotation of the impeller, the cutting portion is located on the inner peripheral side of the impeller, and is located on one surface side of the vane portion, and the tip portion is located on the outer peripheral side, and is provided across the vane portion from a surface on one side to a surface on the other side in a thickness direction.

7. The non-clogging pump according to claim 1, wherein the vane portion is a first vane portion and the impeller further includes a second vane portion, wherein the first and second vane portions are provided on opposite sides of the central protruding portion such that the central protruding portion is sandwiched, when viewed from the suction port side.

* * * * *